United States Patent [19]

Vitta

[11] Patent Number: 4,758,111

[45] Date of Patent: Jul. 19, 1988

[54] PROTECTIVE ENCLOSURES

[76] Inventor: Michael Vitta, 7 Elmwood Ave., Salem, N.H. 03079

[21] Appl. No.: 933,123

[22] Filed: Nov. 21, 1986

[51] Int. Cl.[4] ..... E04B 1/00; F16D 1/00

[52] U.S. Cl. ..... 403/176; 52/656; 52/280; 52/646

[58] Field of Search ..... 182/179, 185; 403/231, 403/403, 171, 174–176; 108/156; 248/188, 188.8; 52/23, 63, 93, 645, 646, 656, 280

[56] References Cited

U.S. PATENT DOCUMENTS

| | | | |
|---|---|---|---|
| 396,918 | 1/1889 | Butler | 248/188 |
| 797,474 | 8/1905 | Walker | 52/93 |
| 2,931,129 | 4/1960 | Boniface | 403/176 |
| 3,531,899 | 10/1970 | Bartlett | 52/23 |

FOREIGN PATENT DOCUMENTS

| | | | |
|---|---|---|---|
| 637526 | 3/1962 | Canada | 403/174 |
| 588259 | 2/1959 | Italy | 403/400 |
| 618759 | 2/1949 | United Kingdom | 108/156 |
| 677347 | 8/1952 | United Kingdom . | |

*Primary Examiner*—James L. Ridgill, Jr.
*Attorney, Agent, or Firm*—Edward A. Gordon

[57] ABSTRACT

A device for forming joints in the fabrication of enclosure frames is disclosed comprising a first, second and third sleeve members each adapted to slidably receive a frame member. The sleeve members are constructed and arranged to be attached to each other so that the axes of the sleeve members are generally mutually perpendicular whereby two sleeve members are adapted to receive lateral frame members and one sleeve member is adapted to receive a vertical frame member. Securing means are associated with each sleeve member for releasably securing the frame members within the sleeve members. A skeletal frame for enclosures formed of the joint forming devices is disclosed.

4 Claims, 3 Drawing Sheets

PROTECTIVE ENCLOSURES

FIELD OF THE INVENTION

This invention relates generally to temporary protective enclosures and more particularly to a device for forming joints in the fabrication of enclosure frames.

BACKGROUND OF THE INVENTION

It is common in the prior art to construct temporary protective enclosures. Such prior art enclosures or structures are constructed generally in a similar manner to more permanent structures. Typically, the framework is nailed together and covered with a material such as plywood, corrugated steel, plastics or composite materials in sheet form. The covering is also nailed or bolted to the framework. Typically, such shelters provide temporary protective enclosures for equipment and materials to be used at a work site. Erection and disassembly of such structures is time consuming and expensive. Applications of such prior art enclosures include: utility storage shelters, equipment shelters and temporary warehouses. When such prior art structures are to be used to seal out airborne contaminant particles additional complex and expensive sealing materials are required to provide a protective enclosure. With the present requirements that hazardous materials such as asbestos be removed from existing structures, there is a great need to provide temporary protective enclosures, which can be quickly and easily erected at the site by unskilled persons, which is substantially imprevious to contaminants, and which can be easily disassembled and removed.

While the availability of transparent and translucent forms of synthetic plastic sheet materials such as polyvinylchloride and polyethylene, provide suitable covering material for protection against contaminants such as asbestos, there still exists a need to provide a low cost skeletal frame structure which is easily erected and disassembled with a minimum of inexpensive materials.

Accordingly it is a desirable object of the present invention to provide a device for forming joints to permit the fabrication of simple, low cost enclosure frames.

Another desirable object of the present invention is to provide a skeletal frame structure that can be easily erected and disassembled by an unskilled person.

A still further desirable object of the present invention is to provide a shelter frame that can be fabricated in a wide range of sizes.

It is yet a further desirable object of the present invention to provide a joint forming device which permits the fabrication of enclosure frames suitable for covering with synthetic plastic sheet material.

A still further desirable object of the present invention is to provide a temporary protective enclosure which is easily erected and disassembled.

The above and other desired objects, apparent from the drawings and following description, may be attained by the apparatus, construction, arrangements and combinations, subcombinations, and parts which comprise the present invention, preferred embodiments of which are illustrative of the mode in which applicant has contemplated applying the principal, being set forth in detail in the following description and illustrated in the accompanying drawings.

SUMMARY OF THE INVENTION

The present invention reduces the difficulties and disadvantages of the prior art by providing a device for forming joints in the fabrication of enclosure frames and which is especially adapted for use in the construction of temporary protective enclosures. More particularly, in accordance with the present invention, the device for forming joints comprises three sleeve members each adapted to slidably receive a frame member. The sleeve members are attached to each other so that the axes of the sleeve members are substantially mutually perpendicular. In a preferred embodiment one sleeve member, sometimes referred to as the inner sleeve member, is disposed within the right angle formed by the other sleeve members, sometimes referred to as the outer sleeve members, which are attached to the inner sleeve member. The inner sleeve member is preferably disposed within the plane of the structure formed by the adjacent outer sleeve members. The inner sleeve member is preferably L-shaped and provides first and second sleeve portions disposed at right angles to each other and adapted to receive a frame member in a selected sleeve portion. Each sleeve member is provided with fastening means to releasably secure at least the end portions of elongated frame members. A typical rectangular enclosure is formed by employing the joint forming device of the present invention in each of the corners and joining them together with lateral and vertical elongated frame members. The frame structure so formed can be covered with a plastic film, sheeting or other suitable materials to provide a protective enclosure. By selecting the lengths of the lateral and vertical frame members the size of the enclosure can be controlled.

The joint forming device of the present invention permits temporary protective enclosures to be quickly and easily erected and disassembled while utilizing a minimum of low cost materials.

BRIEF DESCRIPTION OF THE DRAWINGS

For a fuller understanding of the nature and desired objects of the invention, reference should be had to the following detailed description taken in connection with the accompanying drawings, wherein like reference characters refer to corresponding parts throughout the several views and wherein.

DETAILED DESCRIPTION OF THE PREFERRED EMBODIMENTS

Figure 1:
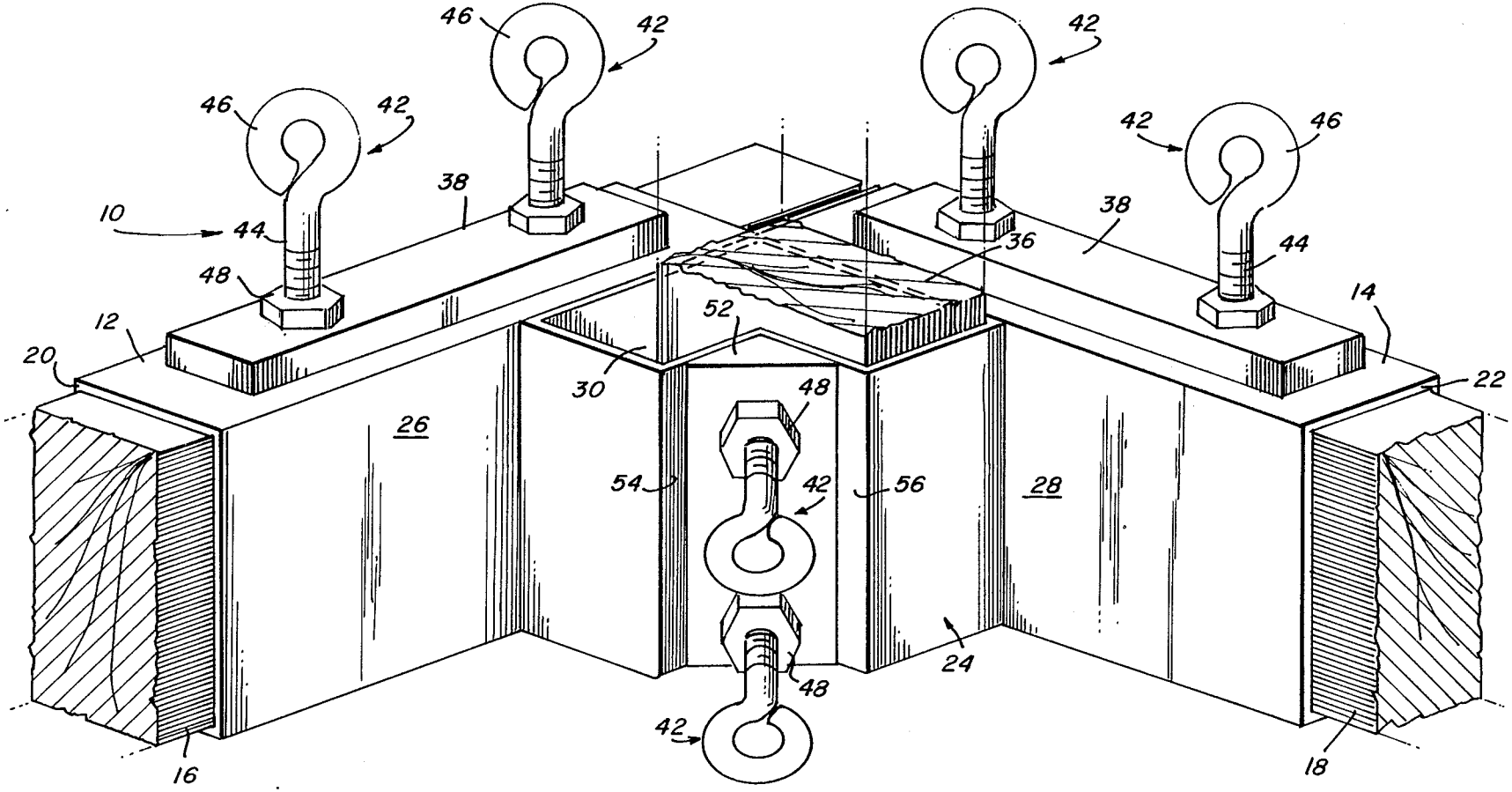
FIG. 1 is a perspective view of a joint forming device in accordance with the present invention showing in fragmentary form the insertion of frame members into the sleeves.
Figure 2:
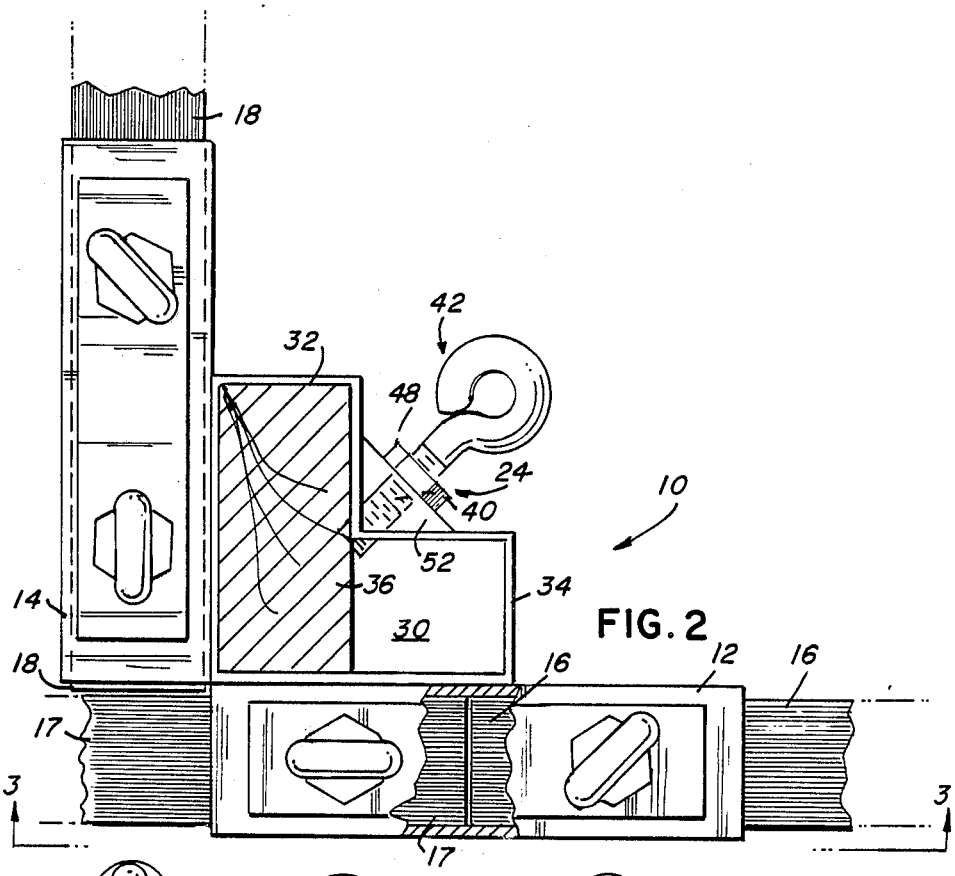
FIG. 2 is a top elevation view of the Joint forming device of FIG. 1 and further having a portion of one sleeve broken away to illustrate the insertion of two frame members to provide an extended frame structure.
Figure 3:
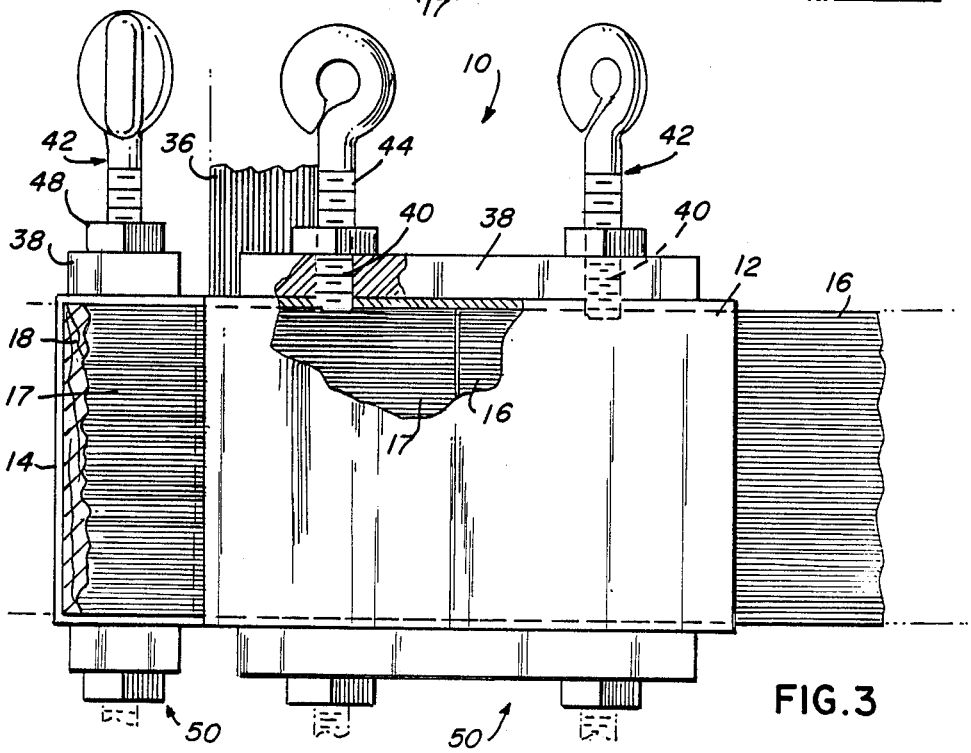
FIG. 3 is a fragmentary side elevation view of the joint forming device of FIG. 2 taken along the line 3—3 and further illustrating a modified form of the means for releasably securing the frame members.

Referring now to the drawings, and more particularly to FIGS. 1–3, there is shown a joint forming device of the present invention designated generally at 10.

The joint forming device 10, preferably formed of metal, has first and second sleeve members designated 12 and 14 which are adapted to slidably receive elongated frame members 16 and 18 in sleeve channels 20 and 22. The sleeve members 12 and 14 are attached, as by welding, at a right angle to each other. A third or inner sleeve member 24 is disposed within the angular area formed by first and second outer sleeve members 12 and 14 and is securly attached, as by welding, to the surfaces 26 and 28. The inner sleeve member 24 is also disposed within the plane of the structure formed by the outer sleeve members i.e. the inner sleeve member 24 may be co-extensive with but does not extend beyond the limits of surfaces 26 and 28 of the outer sleeve members 12 and 14 respectively as best shown by the lead lines A—A and B—B of FIG. 1. As used in the specification and claims the term within the plane of the structure formed by the outer sleeve member shall have the foregoing meaning. The inner sleeve 24 also serves to support outer sleeve members 12 and 14 in their angular relationship to each other. The inner sleeve member 24 is provided with an L-shaped sleeve channel 30 having first and second sleeve channel portions designated as 32 and 34. The sleeve channel portions 32 and 34 are adapted to cooperate to slidably receive an elongated frame member 36, which is illustrated as being inserted in channel portion 32. Although not shown, it is to be understood that frame member 32, if selected by the user, can be inserted into channel portion 34 in the same manner as illustrated with respect to channel portion 32. The sleeve members 12 and 14 are provided with means for releasably securing the elongated frame members 16 and 18 within the sleeves and which comprises an elongated rectangular boss member 38 having internally threaded openings 40 and fasteners 42 which have a lower threaded portion 44 which threadably penetrate threaded openings 40 to engage frame members 16 and 18. Fastener members 42 are provided with a handle or wrench receiving upper portion 46 to facilitate rotation of the fasteners 42 into locking engagement with the frame members 16 and 18. Additionally, a locking nut 48 can be provided to releasably secure fasteners 42 in locking engagement with the frame members.

Referring now particularly to FIG. 3, there is illustrated a modified embodiment of the outer sleeve member 12 and 14. As shown, the outer sleeve members 12 and 14 are provided with additional means for releasably securing the elongated frame members 16 and 18 which are, for simplicity, designated 50 and are constructed in the same manner as described above. Such additional means 50 can be provided to enhance the means for securing the frame members and the reversible or universal features of the joint forming device of the present invention.

Referring now more particularly to FIGS. 1 and 2, the inner sleeve member 24 is provided with means for releasably securing elongated frame member 36 with the sleeve 24 and which comprises an elongated triangular boss member 52 adapted to be secured, as by welding, to the adjacent surfaces 54 and 56 of sleeve 24 and has internally threaded openings 40, fasteners 42, and locking nuts 48 as described above with respect to the outer sleeve members 12 and 14.

Figure 4:
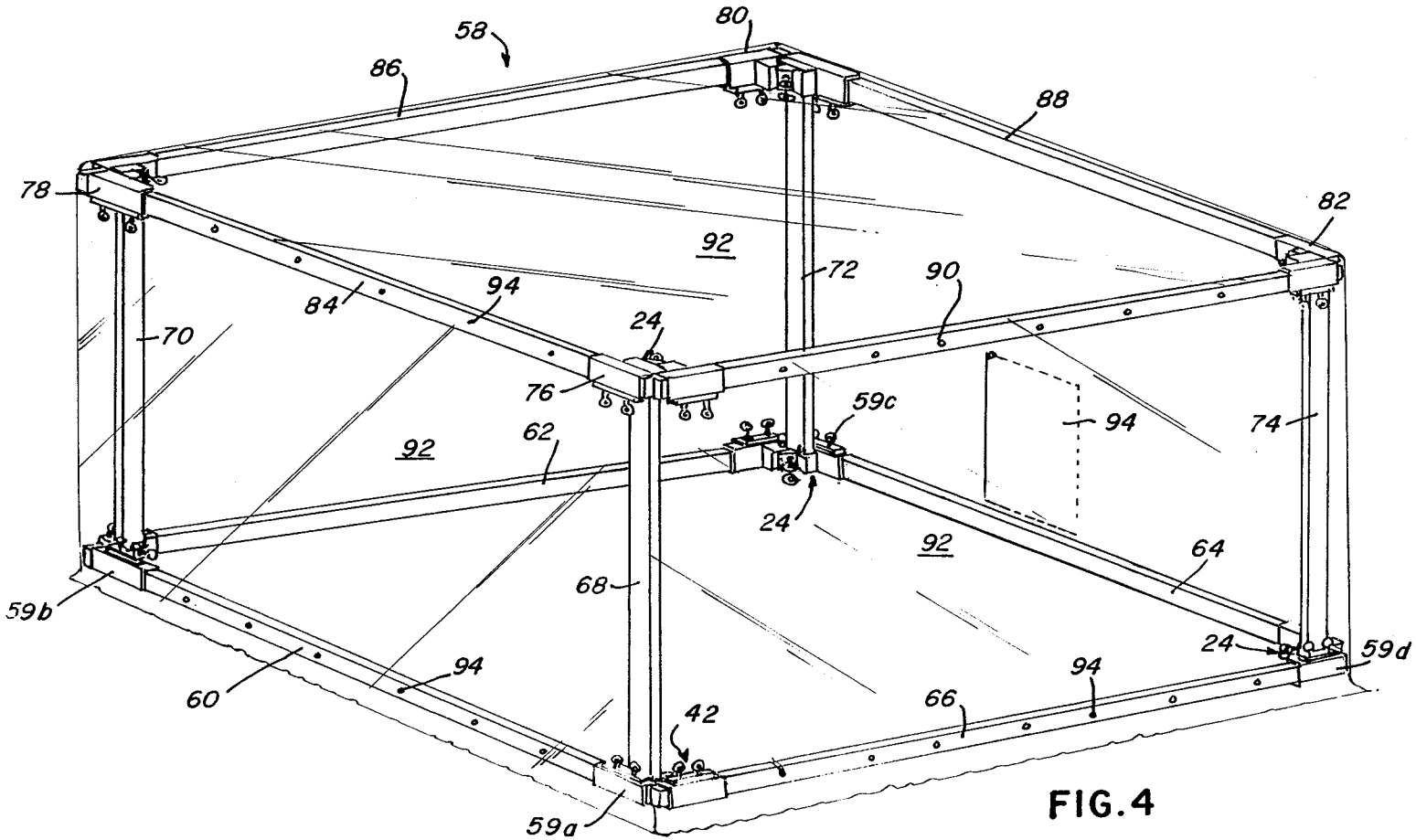
FIG. 4 is a perspective view of an enclosure erected with the joint forming device of the present invention using plastic sheet material as the covering.

Referring now to FIG. 4 there is illustrated an enclosure, designated generally at 58, erected with the joint forming members of the present invention. As shown the frame structure of enclosure 52 comprises a generally rectangular structure formed from joint forming devices of the present invention as described and shown, for example, in FIG. 1, joined together by elongated frame members. The frame structure comprises a base frame formed of joint forming members 59*a*, 59*b*, 59*c* and 59*d* which are joined together by inserting the ends of elongated lateral members 60, 62, 64 and 66 into the outer sleeves of the joint forming devices and locking each in position by the fasteners 42. The elongaged frame members, for example, can be suitably formed of standard 2×4 inch wood studs which are cut to the desired length. In this embodiment the internal diameters or channels of the outer and inner sleeve members are equal to the outside diameters of the frame members 60–66 inserted therein. Vertically disposed in each inner sleeve 24 of joint members 59*a*–59*d*, are elongated vertical frame members 84, 86, 88 and 90 which are also suitably formed of 2×4 inch wood studs. The upper ends of elongated vertical members are similarly inserted into the inner sleeves of upper joint members 76, 78, 80 and 82 and locked therein by fastener means 42. Elongated lateral frame members 84, 86, 88 and 90 are inserted into the outer sleeves of the upper joint members as shown to form the upper frame of structure 58. The frame structure is then covered or enclosed with sheets of plastic material 92 such as polyvinyl which can be attached to the frame members by suitable attaching means such as staples 94 and is provided with a zipper-type opening 94.

It is to be understood that while the invention has been described with respect to preferred embodiments, modifications may be made within the scope of the invention. For example, while FIG. 4 illustrates one form of an enclosed structure, it is apparent that the structure can be extended with additional joint members and frame members as required. As shown in FIG. 2, frame member 16 is inserted into a portion of sleeve 12 and secured with the adjacent fastener 42 while frame member 17 is inserted into the adjacent portion of sleeve 12 and secured by adjacent fastener 42. It is apparent then that in this manner the frame structure of the present invention can be extended or adjacent structures formed. Additionally, the joint members may be employed in different positions to form joints as needed or required. For example, referring still to FIG. 2, outer sleeve 12 and inner sleeve 24 can form the lateral sleeves while outer sleeve 14 can serve as the vertical sleeve. When boss member 38 and internally threaded openings 40 are provided on the upper and lower surfaces of the outer sleeve members 12 and 14, as shown in FIG. 3, the joint members become reversible or universal joint members in that a joint member so constructed can be employed in any corner position or intermediate position where extension is involved without the need for specific selection or orientation to achieve the same. Additionally, it can be appreciated that the frame may be covered with other materials such as fabric, aluminum, corrugated steel or fiberglass.

While the invention has been described with respect to preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in a limiting sense.

I claim:

1. A device for forming joints in the fabrication of enclosure frames comprising:

a first sleeve member adapted to slidably receive an elongated frame member;

a second sleeve member disposed at a right angle to said first sleeve member and also adapted to slidably receive an elongated frame member;

a third sleeve member disposed within the angle formed by said first and second sleeve members and within the plane of the structure of said first and second sleeve members;

said third sleeve member having first and second rectilinear channel portions communicating with each other and disposed at a right angle to each other;

said first and second rectilinear channel portions adapted to slidably receive an elongated frame member in a selected rectilinear channel portion;

said first and second sleeve members being attached to said third sleeve member whereby said first and second sleeve members and said third sleeve member are mutually perpendicular to each other; and means associated with each said sleeve members for releasably securing said frame members within said sleeve members.

2. A skeletal frame for temporary enclosures comprising:

A base frame having a front frame member, a rear frame member and two side frame members connected together;

an upper frame having a front frame member, a rear frame member and two side frame members connected together; and vertical members connected between said base frame and said upper frame supporting said base frame and said upper frame members in spaced relationship;

wherein the connections of the members of said frame are formed by a joint forming means comprising;

a first sleeve member adapted to slidably receive a frame member;

a second sleeve member disposed at a right angle to said first sleeve member and adapted to slidably receive a frame member; and a third sleeve member disposed within the angle formed by said first and second sleeve members and within the plane of the structure at said first and second sleeve members and adapted to slidably receive a frame member;

said first, second and third sleeve members being attached to each other whereby the axes of said sleeve members are mutually perpendicular.

3. The skeletal frame as defined in claim 2 further comprising cover means formed to be disposed upon said frame and thereby form an enclosure.

4. The skeletal frame as defined in claim 3 wherein said cover means comprises a flexible plastic material.

* * * * *